United States Patent [19]

Runyon

[11] Patent Number: 4,937,987

[45] Date of Patent: Jul. 3, 1990

[54] TEMPORARY BUILDING STRUCTURE

[76] Inventor: John F. Runyon, 91 Kent St., Apt. 4, St. Paul, Minn. 55102

[21] Appl. No.: 321,358

[22] Filed: Mar. 10, 1989

[51] Int. Cl.[5] ..... E04B 1/32

[52] U.S. Cl. ..... 52/70; 52/81; 52/DIG. 10

[58] Field of Search ..... 52/80, 86, 81, DIG. 10, 52/70, 71

[56] References Cited

U.S. PATENT DOCUMENTS 4,133,149 1/1979 Angress ..... 52/DIG. 10
4,145,850 3/1979 Runyon ..... 52/71
4,551,726 11/1985 Berg ..... 52/81

*Primary Examiner*—Henry E. Raduazo

*Attorney, Agent, or Firm*—Burd, Bartz & Gutenkauf

[57] ABSTRACT

Economical temporary building structures formed from a skeleton of thirteen squares, each divided along its diagonal to form a basic structure of twenty-siz triangles. When the triangles are panels, twenty-four are assembled into four trapezoidal modules of six aligned panel units each which are joined along their longer bases to form two double modules. When seen as laid flat, the double modules are joined at a right angle along one of their non-parallel ends. A three-dimensional structure is formed by folding the assembly and bringing the opposite ends of the double modules together. Alternative forms of structure are disclosed along with various means of flexibly assembling triangular panel units.

15 Claims, 3 Drawing Sheets

FIG.8
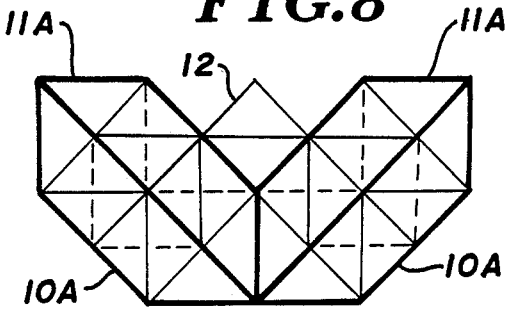
FIG.9
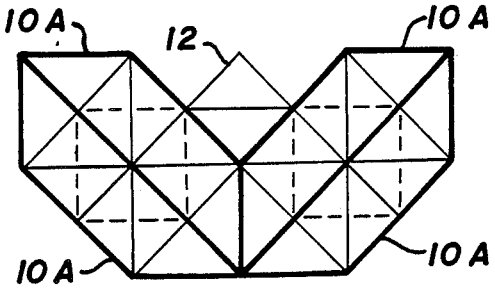
FIG.11
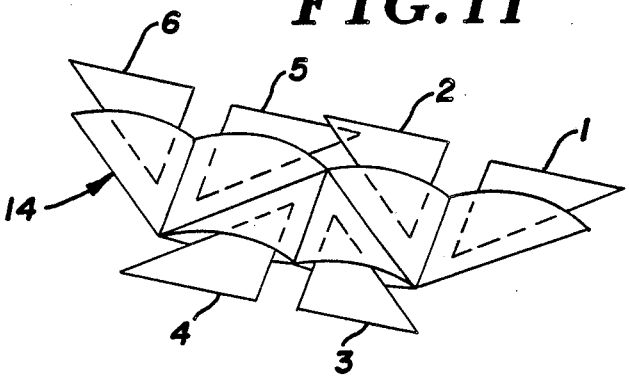
FIG.10
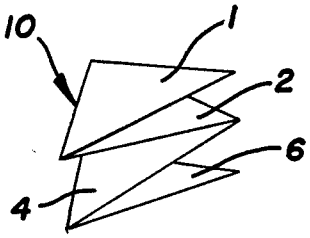
FIG.12
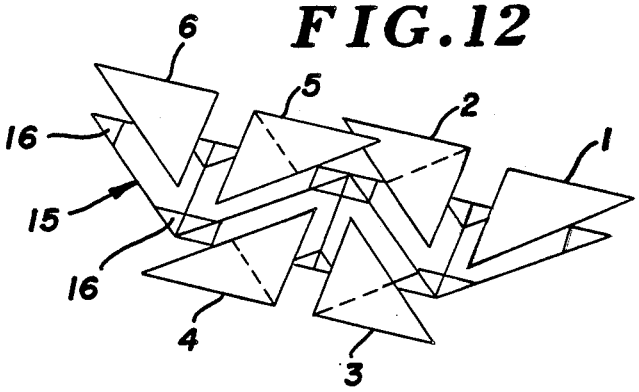
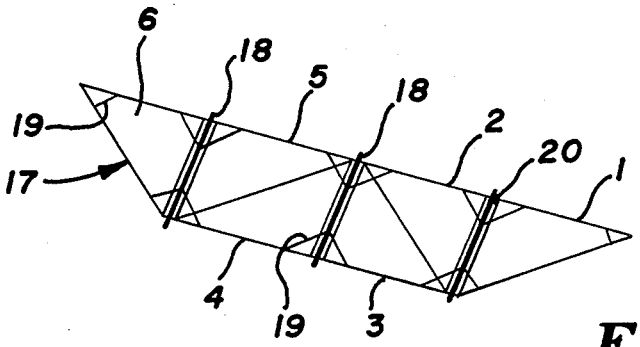
FIG.13

FIG. 14
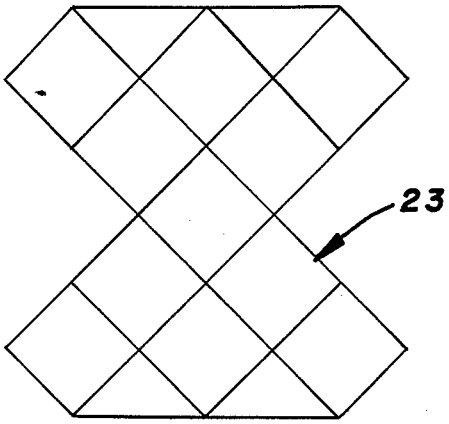
FIG. 15
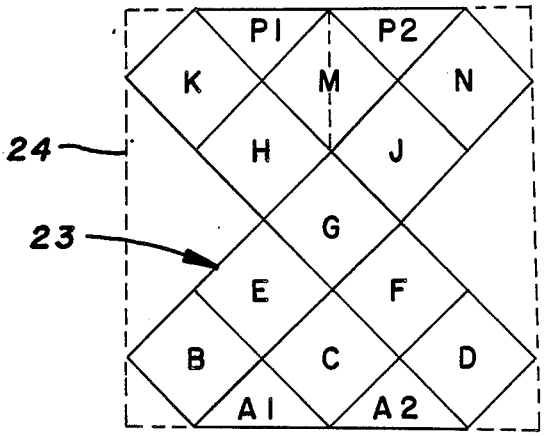
FIG. 16
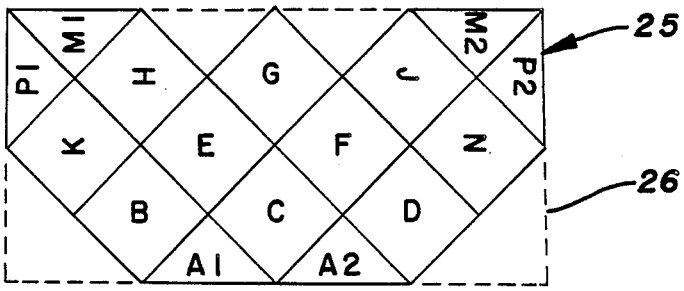
FIG. 17
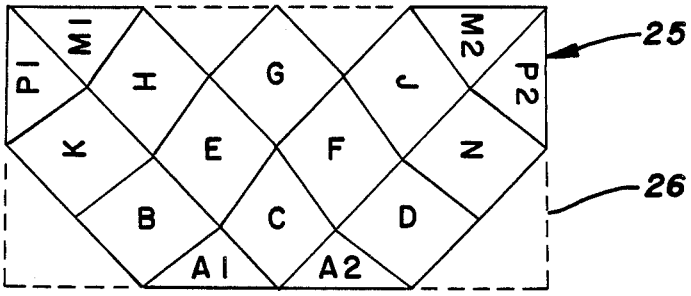
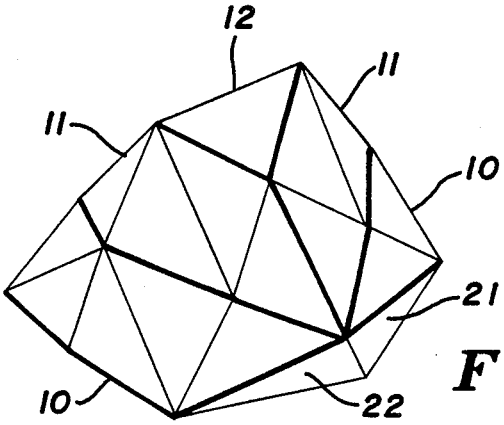
FIG. 18

TEMPORARY BUILDING STRUCTURE

BACKGROUND TO THE INVENTION

1. Field of the Invention

This invention is directed to economical, easily erected temporary building structures constructed mainly from right isosceles triangular shaped panel units. Such panel units are half of a square and may be separate, or made by scoring and creasing larger sheets of panel stock to from a preassembly of mainly right isosceles triangles. Building structures are formed by brining together and fastening selected panel edges in abutting edge-to-edge relation. Because of the ease with which the building are assembled and disassembled, structures built according to the present invention are especially adapted for such uses as temporary shelters, ice fishing houses, children's playhouses, and the like, etc.

2. The Prior Art

In my prior U.S. Pat. No. 4,145,850, issued Mar. 27, 1979, there is shown a folding dome-like modular building structure composed of 48 flexibly interconnected right isosceles triangles. Each building structure is formed from a series of four flexibly connected modules of 12 triangles each. The modules are connected in alternating right and left handed strctural mirror image sequence. In one embodiment, each triangle may be a rigid panel or an open space enclosed by panel edges.

Although constructed mainly from right isosceles trianglar panels, the building structure of the present invention utilizes those triangular panels in a different basic configuration and is intended for use in simpler and smaller temporary structures of different character from those of my earlier patent.

SUMMARY OF THE INVENTION

Broadly stated, the present invention in its preferred form is directed to a temporary foldable building structure comprised of a plurality of twenty-six right isosceles triangular panel units of the same size flexibly connected together. In the preferred embodiment, twenty-four of the triangular panel units are assembled into four trapezoidal modules of six aligned panel units each. These trapezoidal modules are joined along their longer bases to form two double modules. These double modules are joined at right angles along one of their non-parallel ends. A square composed of two right isosceles triangular panel units joined along their hypotenuses are joined along two adjacent short edges of one of the triangular panel units to the double modules at their right angle juncture. A three-dimensional structure results when the assembly is folded and opposite ends of the double modules are brought together.

The triangular panel units forming the trapezoidal modules may be assembled in alignment in two different ways. The panel units may be aligned as three abutting double-size right isosceles triangles or they may be aligned as one double-size right isosceles triangle between two abutting parallelograms. The structure formed differs depending upon the configuration of triangular panel units composing the trapezoidal modules; those containing the three abutting double-size triangular confguration allow very compact folding.

BRIEF DESCRIPTION OF THE DRAWINGS

The invention is illustrated by the accompanying drawings in which corresponding parts are identified by the same numerals and in which:

FIG. 8 shows the components of FIG. 2 in plan view laid flat and modified by division of certain of the triangular panels into two equal smaller triangles representing another method by which the assembly of FIG. 2 may be changed into the assembly of FIG. 4;

FIG. 9 shows the components of the temporary structure in plan view laid flat constructed with four identical trapezoidal modules modified by dividing certain of the triangular panels into two equal smaller triangular panels to allow both the assembly of FIG. 4 and the assembly of FIG. 2;

FIG. 10 is a schematic perspective view showing how certain of the trapezoidal modules can be folded into a compact stack of triangular panels;

FIG. 11 is a schematic perspective view showing one method by which triangular panels may be joined into trapezoidal modules;

FIG. 12 is a schematic perspective view showing another method by which triangular panel may be formed into trapezoidal/modules; and FIG. 13 shows an alternative form of joining lightweight panels together;

FIG. 14 is a plan view laid flat of the base skeleton from which the structures of the present invention are derived;

FIG. 15 shows the base skeleton laid out on a single sheet;

FIG. 16 shows how the base skeleton on a single sheet may be transformed into the more economically efficient shape of FIGS. 2, 4, 8 and 9;

FIG. 17 shows a modified form of the base skeleton of FIG. 16 with certain of the panels distorted; and FIG. 18 is a schematic perspective view showing how the area of a temporary structure may be increased by the addition of marrow auxiliary triangular panels.

DETAILED DESCRIPTION OF THE PREFRRED EMBODIMENT

The temporary structures according to the present invention are formed from a base structure consisting of 13 equal sized squares divided in half to form 26 equal sized right isosceles triangular panel units, some or all of which may be further divided into two equal smaller right isosceles triangles for compact folding, or to allow the structure to assume alternate shapes.

A right isosceles "triangular panel unit" as used herein refers to a stiff rigid or semi-rigid right isosceles triangular panel of given size, or "standard" size for that structure or its equivalent. For example, as described hereinafter, in some instances a triangular panel unit may consist of two equal sized smaller half-size right isosceles triangular panels which together equal the panel of a given or standard size. In some instances, a triangular panel unit may be an open triangular space abutting stiff panels on two or three sides or it may be an open skeleton panel formed by struts or frame edges. Such openings admit light and permit ventilation and may be coverd with transparent, translucent or opaque sheet material. After a structure is erected it is possible to replace selected panels with a single panel equal to two or more triangular panel units.

The panels may be made of a variely of materials depending upon anticipated use of the assembled structure and weight limitations. Plywood and other wood paneling and structural boards, which come in standard sizes lending them to no-waste utilization, are exemplary materials. For lightweight structures, polystyrene foam insulation boards, such as Styrofoam, may be used. Polyisocyanurate foam insulation boards with aluminum foil facing, such as that sold under the brand name Celotex, are preferred. Transparent or translucent panels may be cut from polymethlmethacrylate sheeting, such as Lucite.

Common building panels which are two units high and one unit wide may be cut in half to form two squares with no waste. Each of these squares may be cut in half along a diagonal to form two right isosceles triangles, again with no waste. A 4 foot×8 foot panel, for example, can be cut into four such triangles each 4 feet along its short side.

Figure 1:
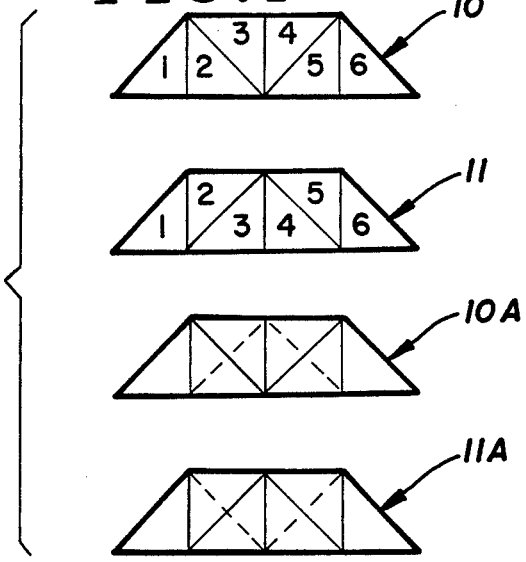
FIG. 1 shows four representative trapezoidal structural modules laid flat in plan view.

As shown in FIG. 1, the right isosceles triangular panels are assembly into trapezoidal modules of six triangles each, designated 1 through 6. In module 10, six triangular panels are assembled into three aligned and abutting double-size right isosceles triangles composed of triangles 1 and 2, 3 and 4, and 5 and 6. In module 11, the center panels 3 and 4 form one double-size right isosceles triangle which is sandwiched between two abutting parallelograms, the first formed from panels 1 and 2 and the other from panels 5 and 6. In module 10A, the alignment of panels 1 through 6 is identical to module 10 except that triangles 2 through 5 are each divided or scored, as shown by broken lines, into equal smaller half-size right isosceles triangles. Similarly, in module 11A, the alignment of panels 1 through 6 is identical to module 11 except that panels 2 through 5 are divided or scored, as shown.

Figure 2:
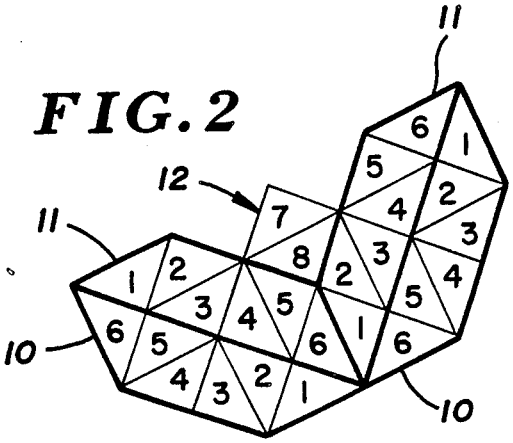
FIG. 2 shows the components of constructing one form of temporary structure laid flat in plan view.

Referring to FIG. 2, there is shown an assembly of 26 right isosceles triangular panels using four trapezoidal modules of six panels each, two each of modules 10 and 11. The two pair of trapezoidal modules are joined into double module pairs along their longer bases, each double module being composed of one module 10 and one module 11. These double module pairs are joined at a right angle along one of their non-parallel ends, the hypotenuses of panels 6 and 1 of adjacent modules 11 being brought into abutment. To complete the structure, a peak square or top member 12 in the form of a square composed of two right isosceles triangular panels 7 and 8, which are identical to panels 1 through 6, is joined to the double module pairs at their juncture. One short edge of panel 8 is joined to a corresponding edge of panel 5 of one module 11. The other short side of panel 8 is joined to the corresponding side of panel 2 of the other module 11. The panels being flexibly joined together, when the edges formed by the hypotenuses of panels 1 and 6 at the free ends of modules 11 are brought together, the assembly forms the structure shown in FIG. 3.

Figure 4:
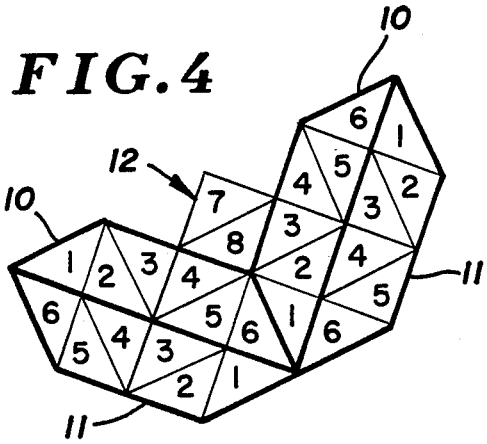
FIG. 4 shows the components for constructing an alternative form of temporary structure laid flat in plan view.

FIG. 4 shows an assembly of flexibly connected triangular panels similar to the assembly of FIG. 2 except that the positions of modules 10 and 11 are reversed. When this assembly is folded to bring together the end edges of modules 10, the hypotenuses of panels 1 and 6, the structure of FIG. 5 results.

Figure 6:
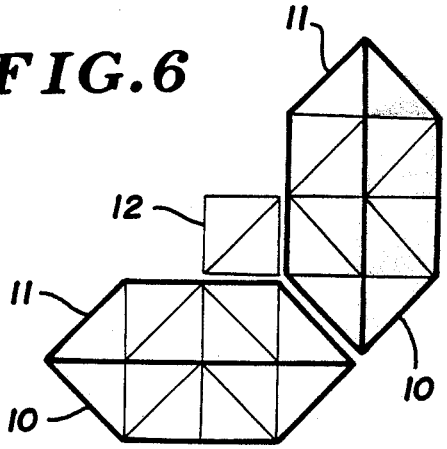
FIG. 6 shows the components of FIG. 2 in plan view laid flat but separated into three segments.
Figure 7:
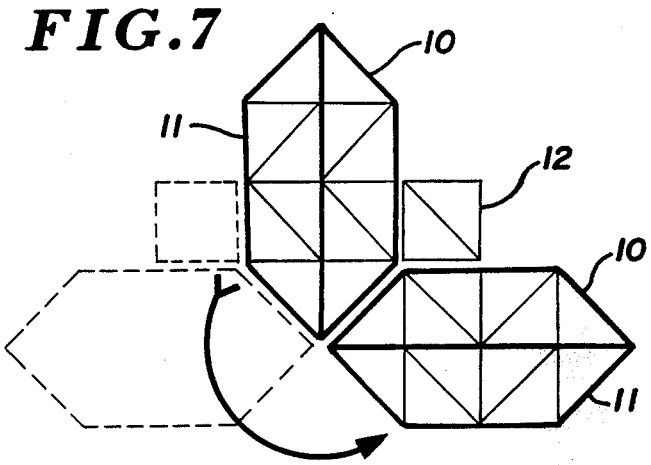
FIG. 7 shows how the components comprising the three segments of FIG. 6 may be reassembled to change the assembly of FIG. 2 into the assembly of FIG. 4.

In FIG. 6, the assembly of FIG. 2 is shown broken into three parts: two symmetrical double module assemblies of twelve triangles each and a top square member 12. FIG. 7 shows how the three parts of FIG. 6 may be reassembled to change the assembly of FIG. 2 into the assembly of FIG. 4.

FIG. 8 shows an assembly of triangular panels similar to that of FIG. 2 except that modules 10A and 11A are substituted. In modules 10A and 11A, the center panels 2 through 5 are divided into equal smaller right isosceles triangular panels. The broken lines representing the dividing lines may be viewed as hypotenuses of alternative right triangular panels, each composed of two half size triangles, functioning as alternate creases and representing a method of changing the assembly of FIG. 2 into the assembly of FIG. 4 Similarly, in FIG. 9 there is shown an assembly similar to that of FIG. 2 or 4 but substituting module 10A so that each of the modules is the same. Again, the broken lines dividing each of panels 2 through 5 into two equal half size triangles form hypotenuses of alternate two-part triangular panels functioning as alternate creases representing another method of changing the assembly of FIG. 2 or 4 into the other form of assembly.

Referring to FIG. 1, each trapezoidal module can be seen as equal sized strips of six triangular panels each. Modules 10 and 11 are of equal size but the center diagonals between panels 2 and 3 and 4 and 5, respectively, of module 11 are slanted in the same direction as the end diagonals, forming parallelograms at opposite ends of the module, as previously described. The center diagonals of module 10 are slanted in the opposite direction. The module can be folded into a compact stack of six triangular panels each lying directly on the top of the next, as shown in FIG. 10. Module 11 cannot be similarly folded. However, modified module 11A, having additional fold lines as represented by the broken lines, may than be folded into a compact stack of six panels, the center panels each being composed of two identical smaller triangles, analogous to module 10.

To provide structures produced from four identical modules, the construction of 10A is preferred, because it is the compact folding construction of module 10 with creases added to allow it to function as module 11. Structures having the shape of FIG. 3 or of FIG. 5 or parts of both are available from the same erected structure.

The utility of the structural modules for forming lightweight temporary shelters is enhanced by compact folding. For example, if triangular panels are cut from 0.75 inch thick foam insulating board, each trapezoidal module folds to a stack of six panels only 4.5 inches thick. Two modules stack to 9 inches. If the panels are cut from standard 4 foot×8 foot commercially available insulating board, the panels have 4 foot short sides. Four folded trapezoidal modules can fit in a lightweight box 4 feet square by 9 inches thick, yet they form an insulated shelter 8 feet × 11.2 feet at its base with a peak 7.2 feet high.

One simple method of joining lightweight panels is to enclose them in fabric which then servers as a hinge. For example, FIG. 11 shows a cover 14 constructed by sewing together two layers of fabric cut to the shape of the modules of FIG. 1. Seams join the two layers of fabric to separate the trapezoidal cover into six triangular pockets, each capable of receiving one large triangular panel. Zippers, snaps, or other closures on the long and short bases of the trapezoid give access to the six pockets, allowing the cover to be shipped inexpensively and filled with locally obtained foam triangular panels.

Referring to FIG. 12, there is shown another simple method of joining lightweight panels together. A fabic backing sheet 15 is cut to the shape of a trapezoidal module and divided into triangular panels of the desired configuration, as shown in FIG. 1. Each vertex or corner of each resulting triangular fabric panel is provided with a smaller partial pocket 16, each adapted to receive the vertex or corner of a rigid structural triangular panel to hold the structural panels in place. These fabric backing sheets serve as hinges and may be joined together by means of zippers, snaps, or other closures. As an alternative, the partial pockets 16 may be in skeletion form created by a band of strong fabric, preferably elastic, extending across the vertex or corner of each triangular panel of the fabric backing.

FIG. 13 shows another alternative, indicated generally at 17, wherein three rigid poles 18 indicated by dark lines have been added to serve as strong attachment points for elastic fabric, or cord 19, such as Bunge cord. The pull of heavy elastic stretched at each corner is then taken only by the trapezoidal module perimeter and the poles. A double strand of elastic cord at each corner can serve as a panel pocket with one strand against the front and one against the back panel surface.

Whe two panel vertices meet at a corner, they may both slip between the stretched double strands of elastic. A clip joining the two strands at mid-span where the two panels abut then serves to form two separate "pockets".

A narrow strip 20 has been added behind each of the three poles, enlarging the hinge area between the short sides of abutting panels. A strip 20 wide enough to accommodate one pole thickness and two panel thicknesses allows convenient folding when panels are formed by creases in sheet stock. These narrow areas are formed by parallel creases a short distance apart.

Figure 3:
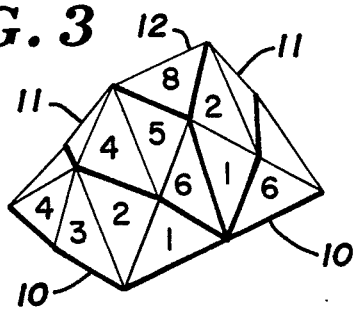
FIG. 3 is a schematic perspective view showing the form of temporary structure assembled from the components of FIG. 2.
Figure 5:
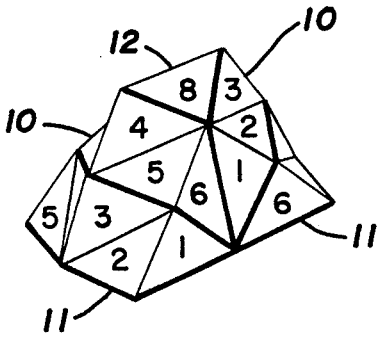
FIG. 5 is a schematic perspective view showing an alternative form of temporary structure assembled from the components of FIG. 4.

FIG. 13 also demonstrates that a six triangle module may be constructed from other than right isosceles triangles, simply by viewing the figure as composed of triangles with three unequal sides. FIGS. 3 and 5 can be viewed as constructed of panels with no equal sides or right angles.

The triangular panels may be formed from two identical half size panels hinged together with durable tape or other hinge means providing the trapezoid with additional fold lines previously discussed for maximum versatility, or the triangular pockets in FIG. 11 may be may halt-size to accommodate half-size triangular panels. If each full size triangular panel is made from two half size triangular panels with short sides 4 feet and hypotenuses approximately 5.7 feet long, four folded trapezoidal modules will fit in a 5.7 foot square by 0.75 , foot high box. They will form a shelter approximetely 11.5 feet × 16 feet at its base with a peak about 10.5 feet high.

If larger structures are desired, each half size panel may in turn be constructed from a pair of panels rigidly joined together to form one larger half size panel. Combining two right isosceles triangles produces a larger similar triangle with sides longer by the ratio $\sqrt{2}$ to 1 (square root of 2 to 1).

As shown in FIG. 18, the floor area of the structure of FIG. 3 may be enlarged approximately 25% by extending the perimeter of the structure at ground level by the addition of narrow auxiliary triangular panels 21 and 22 at ground level, two auxiliary panels on each side.

Top member 12 is composed of two full size triangular panels making a total of twenty-six equal full size triangles for each structure. Either or both of the triangles forming this cover module may be composed of trsansparent or translucent sheet material to allow light into the shelter. Alternatively, the module may be structurally replaced by a bar or rod forming the peak ridge where the two triangular panels forming the module would share a common hypotenuse. That bar or rod is equal in length to the hypotenuse of the triangular panel and is joined to the midpoints of the short bases of adjacent trapezoidal modules. A sheet of rain-proof transparent or translucent flexible material may then be placed over the ridge bar to admit light into the structure. It may be folded back or removed for ventilation. If the ridge bar or rod is made to telescope, the shape of the opening can be distorted, forming a narrow diamond, for example, when the rod is lengthened. Top member 12 may also be replaced by auxiliary framework or panels of various shapes to allow more height inside the structure.

Although preferred methods of flexibly joining triangular panels into trapezoidal are shown in FIGS. 11, 12 and 13, the panels may be joined by any of several conventional hinging systems depending upon the material from which the triangular panels are formed and the ambient condition in which the structure is to be used. Durable flexible pressure-sensitive adhesive tape lends itself to this use. It may also be used to join half size triangles providing additional fold lines, of example, those indicated by dashed lines in FIG. 12. If the triangular panels are formed from plywood or similar sheet material, ordinary hinges may be used to flexibly join adjacent panels. For entrance or egress, one or more of the triangular panels may be detachably joined to its abutting panels on one or two sides. For example, the hypotenuses of the panels 6 and 1 of modules 11 which are brought together to form the structure of FIG. 3 may be detachably joined together. If these panels are also detechably joined to adjacent panels 6 and 1 of modules 10, then they may form a door opening by swinging the panels upwardly along the flexible joint with abutting panels 2 and 5. Or, for example, a crawl-in entrance may be provided by a detachable joint between panles 3 and 4 at one end of the structure of FIG. 3.

FIG. 14 shows a skeleton of squares, indicated generally at 23, which provides the basis of the structures of the present invention. The central square will form the structure top center after it is divided into two triangles by constructing its left-to-right diagonal.

With the diagonal length of one square taken as unit length, FIG. 15 shows how this skeleton may be contained within the outline 24 of a three by three unit area. Eleven whole squares labeled B through N are contained within the outline. Two additional squares A and P have been divided into half squares labeled A1, A2 and P1, P2 to complete the perimeter of the skeleton. The eleven whole squares will also be divided in half to provided an additional twenty-two triangles for a total of twenty-six full size "standard" triangles.

Starting with the divison of square M, the skeleton of FIG. 15 may be transformed into the skeleton 25 of FIG. 16. Here half squares A1, A2 and whole squares B through G are arranged as in FIG. 15, but squares H,K together with half squares P1,M1 have been rotated 90 degrees leftward while squares J,N together with half squares M2,P2 have been rotated 90 degrees rightward.

The skeleton now has the same perimeter shape as that shown in FIGS. 2 and 4, and the remaining whole squares of FIG. 16 may each be divided into two full size triangles to form either the arrangement of FIG. 2 or of FIG. 4. or parts of both.

When panels are formed simply by creases in a single large sheet, (of cardboard, for example) the arrangement of FIG. 16 is more economical than that of FIG. 15. The structure can be cut from a sheet 26 measuring two by four diagonal lengths, equaling eight units of area. The arrangement of FIG. 15 by comparison requires a sheet 25 three by three diagonal lengths, equaling nine units of area, so one more area unit remains as waste when the perimeter is cut from the square sheet.

Also, the narrower dimension of FIG. 16 allows a larger structure to be cut from narrow, long sheets available with roll stock such as cardboard or flexible form. A twelve foot wide roll, for example, allows each square a diagonal length of six feet, which is the dimension of the hypotenuse on each of twenty-six full size "standard" triangles. Dividing by $\sqrt{2}$ (square root of 2) yields 4.24 as the length of the other two triangle sides.

By comparison, full size triangles cut from a four by eight foot panel as previously described, are slightly smaller, measuring 5.7 feet along the hypotenuse and four feet on the other two sides. Thus a complete structure with twenty-six triangles already hinged together as creases, when produced from twelve foot wide stock, will be slightly larger than a structure with individual triangles cut from four by eight foot sheet.

As disclosed above, full size triangles may be divided into two half size triangles as illustrated by dashed lines in FIGS. 8 and 9. When panels are produced by creases in manufacturing the structure from one large sheet, these dashed lines can be additional auxiliary creases. They now connect the lines of creases between full triangles, allowing full length folding of the sheet parallel to its length or width.

Some creases may also be eliminated, or when the structure is made from individual panels, some panels may be combined into a single larger panels. To provide a larger flat surface for mounting a door in the structure of FIG. 3, for example, abutting triangles 1 and 6 may be combined into one square panel, or the two triangles 1 and the two triangles 6 may all be combined into one larger triangular panel containing four times the area of one "standard" full size panel.

Returning again to FIG. 14, the skeleton of these structures is seen as an arrangement of thirteen squares, two of which have been divided into half squares seen at the top and bottom of the figure. The squares are arranged on a plane as:

(A) A central square, (B) Four intermediate squares abutting the four sides of the central square, (C) Four outermost squares abutting the intermediate squares on their sides opposite the central square so that these nine squares together form a cross, (D) A pair of squares at opposite corners of the central square, each abutting two intermediate squares, and (E) Two divided squares split in half to make four half squares such abutting both one of the squares at opposite corners of the central square and one of the four outermost squares.

Referring again to FIG. 15, the central square is square G, the four intermediate squares are E,F,H and J, the four outermost sqares are B,D,K, and N, the pair of squares at opposite corners of the central square are C and M, and the two divided squares making four half squares are AL1,A2 and P1,P2.

FIG. 17 shows the arrangement of FIG. 16, but with certain squares distorted so that all sides and angles are not equal. This skeleton may also be divided into triangles as previously described. Although the resulting triangles are not exact right isosceles triangles, they may still be assembled as described previously and shown in FIGS. 3 and 5. The squares are distorted by changes of lengths and angles of 30% or less.

It is apparent that many modifications and variations of this invention as hereinbefore set forth may be made without departing from the spirit and scope thereof. The specific embodiments described are given by way of eexample only the invention is limited only by the terms of the appended claims.

I claims:

1. A temporary foldable building structure comprised of a plurality of twenty-six right isosceles triangular panel units of the same size flexibly assembly from:

(A) four trapezoidal modules of six aligned panel units each, two pairs of modules each being joined into double modules along their alonger bases and said double module pairs being joined at right angles along one of their non-parallel ends, and (B) a peak square top member comprised of two right isosceles triangular panel units joined along their hypotenuses, said square joined along two adjacent short edges of one of said panel units to said double module pairs at their juncture.

2. A building structure according to claim 1 wherein:

(A) the triangular panel units of two of said trapezoidal modules are aligned as three abutting double size right isosceles triangles, (B) the triangular panel units of the other two of said trapezoidal modules are aligned as one double-size right isosceles triangle between two abutting parallelograms, and (C) said double module pairs contain one of each of said differing modules.

3. A building structure according to claim 2 wherein said double module pairs are joined at right angles long a non-parallel end forming one edge of one of said parallelograms.

4. A building structure according to claim 2 wherein said double module pairs are joined at right angles along a non-parallel end forming one edge of one of said double-size right isosceles triangles.

5. A building structure according to claim 1 wherein at least the center four triangular panel units of each trapezoidal module are each divided into two smaller equal right isosceles triangles.

6. A building structure according to claim 2 wherein at least the center four triangular panel units of each trapezoidal module are each divided into two smaller equal right isosceles triangles.

7. A building structure according to cliam 1 wherein:

(A) the triangular panel units of all of said trapezoidal modules are aligned as three abutting double-size right isosceles triangles, and (B) at least the center four triangular panel unite of each trapezoidal module are each divided into two smaller equal right isosceles triangles.

8. A building structure according to claim 1 wherein:

(A) the triangular panel units of all of said trapezoidal modules are aligned as one double-size right isosceles triangle between two abutting parallelograms, and (B) at least the center four triangular panel units of each trapezoidal module are each divided into two smaller equal right isosceles triangles.

9. A building structure according to claim 1 wherein all of said triangular panel units are stiff rigid or semi-rigid triangular panels.

10. A building structure according to claim 1 wherein the peak square top member is open, consisting of two right isoscels triangles defined by the short sides of the triangular panel units forming the short bases of adjacent right angle trapezoidal modules, and a bar or rod extending between the midpoints of said short bases.

11. A building structure according to claim 10 wherein said peak square top member is covered by a sheet of rain-proof flexible sheet material.

12. A building structure according to claim 1 wherein:

(A) each of said trapezoidal modules a comprised of two layers of fabric sheet material divided into pockets corresponding to the configuration of triangular panel units, and (B) a stiff triangular structural member is inserted into and secured in each pocket.

13. A building structure according to claim 1 wherein:

(A) each of said trapezoidal modules is comprised of a layer of fabric sheet material divided into triangular panels corresponding to the configuration of triangular panel units, (B) a triangular pocket is provided at each vertex or corner of said fabric triangular panels on one side of said layer of fabric sheet material, and (C) a stiff triangular structural member overlies said fabric triangular panels, each vertex or cover of said structural member being engaged in one of said triangular pockets.

14. A buidling structure according to claim 13 wherein said triangular pockets are each formed by a band of fabric extending across each vertex or corner of said fabric triangular panels spaced inwardly from the tips thereof.

15. A building structure according to claim 14 wherein said bands of fabric are elasticized.

* * * * *

UNITED STATES PATENT AND TRADEMARK OFFICE

CERTIFICATE OF CORRECTION

PATENT NO. : 4,937,987

DATED : July 3, 1990

INVENTOR(S) : JOHN F. RUNYON

It is certified that error appears in the above-identified patent and that said Letters Patent is hereby corrected as shown below:

Col. 1, line 14, "brining" should be ---bringing---.

Col. 1, line 16, "building" should be ---buildings---.

Col. 1, line 29, "strctural" should be ---structural---.

Col. 2, line 8, "of" should be ---for---.

Col. 2, line 43, "trapezoidal/modules" should be ---trapezoidal modules---.

Col. 2, line 58, "marrow" should be ---narrow---.

Col. 3, line 37, "assembly" should be ---assembled---.

Col. 3, line 56, "pair" should be ---pairs---.

Col. 4, line 45, "The" should be ---This---.

Col. 4, line 50, "than" should be ---then---.

Col. 5, line 39, "Whe" should be ---Where---.

Col. 5, line 62, "halt-size" should be ---half-size---.

Col. 6, line 35, after "trapezoidal" insert ---modules---.

Col. 6, line 42, "of" should be ---for---.

Col. 7, line 4, "provided" should be ---provide---.

Col. 7, line 30, "form" should be ---foam---.

Col. 8, line 15, "AL1" should be ---Al---.

Col. 8, line 29, "eexample" should be ---example---.

UNITED STATES PATENT AND TRADEMARK OFFICE

CERTIFICATE OF CORRECTION

PATENT NO. : 4,937,987

DATED : July 3, 1990

INVENTOR(S) : JOHN F. RUNYON

It is certified that error appears in the above-identified patent and that said Letters Patent is hereby corrected as shown below:

Col 8, line 30, "claims" should be ---claim---.

IN THE CLAIMS:

Col. 8, line 36, "alonger" should be ---longer---.

Col. 9, line 7, "unite" should be ---units---.

Col. 9, line 23, "isoscels" should be ---isosceles---.

IN THE ABSTRACT:

Abstract, line 7, "twenty-siz" should be ---twenty-six---.

Signed and Sealed this

Twenty-fifth Day of February, 1992

*Attest:*

HARRY F. MANBECK, JR.

*Attesting Officer*

*Commissioner of Patents and Trademarks*